United States Patent [19]

Barr

[11] Patent Number: 4,577,706

[45] Date of Patent: Mar. 25, 1986

[54] ROTARY DRILL BITS

[75] Inventor: John D. Barr, Cheltenham, England

[73] Assignee: NL Petroleum Products Limited, London, England

[21] Appl. No.: 611,008

[22] PCT Filed: Sep. 16, 1983

[86] PCT No.: PCT/GB83/00227

§ 371 Date: May 10, 1984

§ 102(e) Date: May 10, 1984

[87] PCT Pub. No.: WO84/01186

PCT Pub. Date: Mar. 29, 1984

[30] Foreign Application Priority Data

Sep. 16, 1982 [GB] United Kingdom ..... 8226466

[51] Int. Cl.[4] ..... E21B 10/00; E21B 10/60; E21B 10/46

[52] U.S. Cl. ..... 175/329; 175/393; 175/410

[58] Field of Search ..... 175/329, 330, 393, 410, 175/391, 327, 335, 400, 417, 418, 419, 422

[56] References Cited

U.S. PATENT DOCUMENTS

| | | | |
|---|---|---|---|
| 3,112,803 | 12/1963 | Rowley | 175/393 X |
| 3,215,215 | 11/1965 | Kellner | 175/330 |
| 3,308,896 | 3/1967 | Henderson | 175/330 |
| 4,098,363 | 7/1978 | Roh et al. | 175/329 |

FOREIGN PATENT DOCUMENTS

| | | |
|---|---|---|
| 1199209 | 8/1965 | Fed. Rep. of Germany . |
| 2814165 | 8/1979 | Fed. Rep. of Germany . |
| 2085945 | 5/1982 | United Kingdom . |

*Primary Examiner*—Stephen J. Novosad
*Assistant Examiner*—David J. Bagnell
*Attorney, Agent, or Firm*—Browning, Bushman, Zamecki & Anderson

[57] ABSTRACT

A rotary bit for use in subsurface formations comprises a bit body having a central bore (4), the body having a leading face (1) and a trailing gauge region (2), walls (7) on the bit dividing the face into fluid channels, cutting elements C being present on at least some of the walls, and passageways (5) connecting the bore (4) to openings (6) in the fluid channels. At least two wall portions (7) are arranged relative to each openings (6) so that the fluid emerging from the opening is directed to travel first inwardly towards the central axis of the bit before travelling outwardly to the gauge region (2).

14 Claims, 16 Drawing Figures

ROTARY DRILL BITS

The invention relates to rotary drill bits and in particular to bits which are used to drill holes in rock or subsurface formations for example to extract oil, gas or water or in mining or in the removal of cores.

A drill bit comprises a bit body with means for connection to a drill string, a leading bit face and a trailing gauge region. The face of the bit carries cutting elements such as polycrystalline diamond compacts which may be arranged in rows at the leading edges of wall portions known as "blades". The face of the bit may also carry so-called fences to control fluid flow and preferably has so-called kickers to centralise the bit in the hole. Fluid such as drill mud is passed down a central bore in the drill string and body and exits via passageways and openings into fluid channels between the blades and/or fences and kickers to flow past the cutting elements and up to junk slots between the kickers in the gauge region, carrying away cuttings and chippings and serving to cool the formation being drilled.

In known drill bits of this type, the passageways usually lead to openings located in the central region of the bit face, and there are usually many fluid channels which extend away from the centre of the bit. Sufficient fluid channels or waterways are required ot ensure that cuttings and heat are removed from the vicinities of all the cutting elements.

Typical designs have the cutting elements arranged in rows in the leading edges of blades, and have a fluid channel in front of each blade. Depending on the design, there may be 3 to 30 blades and the same number of fluid channels.

In certain rock formations, there is a tendency for the channels to become blocked by cuttings of rock formation, and blockage of one channel means that its associated cutting elements are not cooled and cleaned and the entire flow of fluid passes through the remaining channels. Although this will cause some increase in pressure at all the openings, this increase in pressure will not always be sufficient to unblock the blocked channel, so that the cutters associated with that channel will become overheated and/or clogged and so substantially ineffective. The clogging presents a barrier between the bottom of the hole and the cutting elements, preventing penetration or slowing the rate of penetration of the drill bit. This problem is particularly acute when the drill bit is used to drill certain types of claystone and shale using a water-based drilling fluid.

One solution to this problem is to isolate the fluid channels from each other and to feed each through one or more openings or nozzles of restricted area. The area of the nozzles is chosen so that the pressure difference between the common bore and the fluid channels is large enough to clear an accumulation of cuttings in the channel and prevent a blockage. Examples of bits having these features are illustrated in U.S. Pat. Nos. 2,371,489, 2,371,490, and 3,112,803 and in French Patent Specification No. 1,265,943. To provide enough cutting elements in a compact design, many blades may be required. Even if all the required cutting elements can be accommodated on three or four blades, the fluid channels diverge rapidly which means that fluid velocity falls off towards the edge. This can be corrected by the use of fences, but dead sectors are formed and they are uncooled in use of the bit. For these reasons, more than three or four blades are preferred. In the simple designs, there is one fluid channel in front of each blade and so the number of nozzles cannot be less than the number of blades. The presence of many openings or nozzles with adequate pressure drop requires each opening or nozzle to be small and there is a risk of some of the openings themselves becoming blocked.

It is one object of this invention to provide a drill bit body in which the number of openings is kept to the minimum without an undesirable decrease in the number of blades or fences, consistent with ensuring that there is a suitable fluid flow distribution for the purposes of cleaning and cooling.

It is another object to provide a drill bit in which the support structure for the cutters in the centre portion of the bit face need not be interrupted by large openings or nozzles.

The invention is based on the realisation that by suitably locating the openings and the wall portions, at least part of the fluid may be directed to flow in a single path towards the central axis of the bit before exiting via the gauge region.

According to the invention there is provided a rotary bit for use in subsurface formations comprising a bit body having a central bore, the body having a leading face and trailing gauge region, walls on the bit dividing the face into fluid channels, cutting elements being present on at least some of the walls, passageways connecting the bore to openings in the fluid channels, the channels being arranged to pass most of the fluid from an opening in a single path past the cutting elements to adjacent the gauge region characterised in that at least two wall portions are arranged relative to an opening so that the fluid emerging therefrom is directed to travel towards the central axis of the bit before exiting to the gauge region.

Preferably, most of the openings are located near the periphery of the bit and the fluid channels lead fromm these openings first towards the central axis of the bit and from there outwards to the periphery towards a junk slot. Preferably the openings are few enough and small enough to have a pressure drop of between 10 and 200 atmospheres. Thus, if one fluid channel becomes partly blocked, reduction in flow in that fluid channel will cause the pressure drop across the corresponding opening to be reduced and there is a corresponding increase in pressure available to clear the partial blockage. A high pressure drop across the opening not only increases the exit velocity from them but also helps to stabilise the volumetric rate of flow distribution between the fluid channels.

In practice, most of the fluid emerging from a nozzle is directed to flow in the direction specified. In a much preferred feature of the invention the direction is determined by providing blades and for fences in dispositions to direct the flow; for example gaps may be present between blades and blades and/or fences to direct the flow. Auxiliary nozzles may be present to enhance the flow generally or in particular locations. It is an advantage of the invention that some leakage of the fluid flow can be tolerated provided that most of the fluid emerging from a nozzle is caused to travel along the single path.

The cutting elements in the central region of the bit face can be mounted very strongly because in a bit of the invention major arrival openings are not required in that region. Some of the fluid is forced by the geometry of the channel to pass, wash and cool the cutting elements at the central region. Auxiliary openings may be provided in the centre but they can be small, leaving sufficient space to form a strong support for cutting elements.

Because the cutting elements on the bit face may be aligned with their neighbours the fluid flow near each cutting element may be in a direction substantially parallel to the face of the cutting element, thus giving improved washing away of cuttings. This is an advantage over the bit described and claimed in our European Patent application No. 81.300064.3, publication No. 0,032,791A.

The openings or nozzles will usually be smaller in diameter than the passageways leading from the central bore in the bit body. The invention however includes bits in which the passageways are themselves of sufficiently small cross-sectional area to control the flow or in which a choke or restrictor is present in the passageway.

The cutting elements may be made of known materials; the use of polycrystalline diamond compacts is preferred. The cutting elements will usually be mounted on a leading edge of the blades. The bit body may be made of one or more of a wide variety of materials including infiltrated tungsten carbide matrix, steel or steel coated with tungsten carbide.

Two or more inbound fluid channels may be joined to feed one common outbound channel and so define a single clear path from each of two or more openings.

One important advantage of this invention is that it permits a reduction in the number of openings in proportion to the number of blades. This enables larger openings to be used, reducing the incidence of blockages in the openings themselves. Another is that nozzles may be interchanged.

A further advantage of the present invention is that the fluid flow can be made to function and cool a rock formation and cutters even when the bit is used in a reaming mode. Bits having cutting elements comprising polycrystalline diamond compacts may be required to ream many tens of meters of hole when following worn or under gauge rock bits and before drilling. Bits designed for drilling (not for reaming) having openings for circulation near their central axis sometimes suffer overheating of their outer cutting elements during this reaming operation because the mud velocities at the gauge are small under these conditions. A bit of this invention does not suffer from this disadvantage since the openings, being located adjacent the outer periphery of the bit, provide high velocity turbulent flow of drilling fluid at the periphery, thus providing more effective cooling of the outer cutters and of the surrounding formation.

In order that the invention may be well understood, it will now be described by way of example only, with reference to the accompanying diagrammatic drawings in which.

Where possible, the same reference numerals are used to designate the same parts in the different embodiments.

Figure 1:
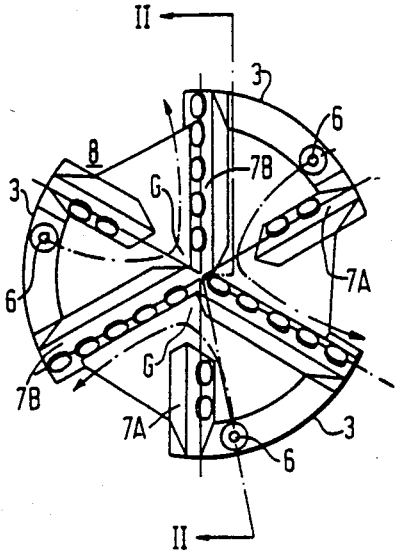
FIG. 1 is a front end view of one bit of the invention.
Figure 2:
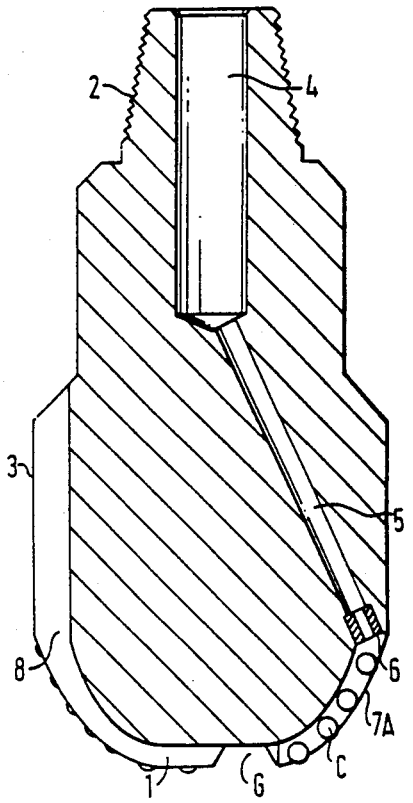
FIG. 2 is a longitudinal sectional view of the bit of FIG. 1 taken on lines II—II.

The rotary bit body of FIGS. 1 and 2 comprises a leading bit end face 1 and a rearward end portion 2 for connection to a drill string, not shown. The intermediate portion comprises a gauge portion having three kickers 3. A bore 4 extends through the connection portion 2 and ends inside the bit. A number of passageways 5 of relatively reduced diameter lead from the bore 4 to the edge or periphery of the bit face where they emerge as outlet nozzles 6: as shown in FIG. 2 there are three such nozzles 6 spaced apart about the circumference of the bit end face. A number of blades 7 is present on the bit end face 1; as shown in FIG. 2 there are six such blades 7, i.e., two blades per nozzle. Three of the blades 7A, extend radially from an outlet to towards the centre axis of the bit end face but stop short of reaching the centre point. The other three blades 7B lie between each pair of blades 7A and meet at the centre point. Cutting elements C each comprising a polycrystalline diamond compact are mounted in a row on one side of each blade to present a cutting edge. Three junk slots 8 extend from the bit face 1 up past the kickers 3, the slots being located on the opposite side of the blade 7A from the adjacent nozzle 6. Because the blades 7A stop short of meeting the blades 7B at the centre point a gap G is defined. In use, drilling mud is pumped down the bore, and the mud flows along the passageways and out through each nozzle 6. As the bit is rotated the cutting elements C of each blade cut or abrade the formation, producing chippings, not shown. The drilling mud from each nozzle flows in the channels defined by the blades past the cutting elements of the adjacent blade 7A, through the adjacent gap G, and past the cutting elements of the adjacent blade 7B and then up a junk slot 8. This is shown by the arrows. The chippings are removed efficiently and the formation is cooled. The wall portions 7A and 7B are thus arranged relative to the nozzle 6 so that the drilling mud flows towards the centre axis of the bit before exiting to the gauge reation. The mud from each nozzle serves to clean two sets of cutting elements. The mud flows in a single common and unbranched path so, should a blockage occur in the path, there is no escape route for the fluid and as a result pressure builds up in the fluid tending to clear the blockage away.

Figure 3:
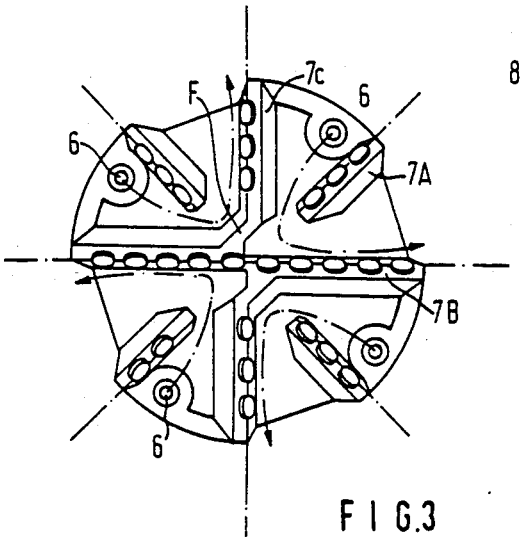
FIGS. 3 to 14 are each a front end view of other bits all within the scope of the invention.

In the bit of FIG. 3, four outlet nozzles 6 are present, and there are a total of eight blades 7. The blades 7B meet at the centre point and are well supported, which of course would not be possible if the bore 4 emerged there and this offers many advantages in terms of bit design, manufacture and strength. The blades 7C are joined to the blades 7B by fences F which separate the channels and add strength.

Figure 4:
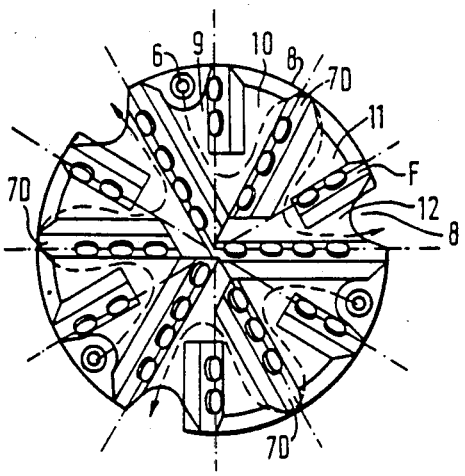

In the bit of FIG. 4, there are three nozzle outlets 6, but a total of twelve wall portions. The blades join the kickers 8 except for blades 7D where there is a gap connecting channels 10 and 11. As a result there is a single path from nozzle 6 to the junk slot 8 through channels 9, 10, 11 and 12. The bit has four blades per nozzle, useful for larger diameter bits e.g. above 44 cm.

Figure 5:
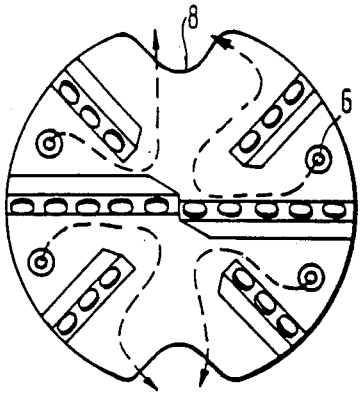

In the bit of FIG. 5, there are four nozzle outlets 6 and six wall portions. As shown by the arrows, the mud is arranged to flow from two outlets 6 into one junk slot 8, so increasing fluid velocity and the cleaning and cooling effect.

Figure 6:
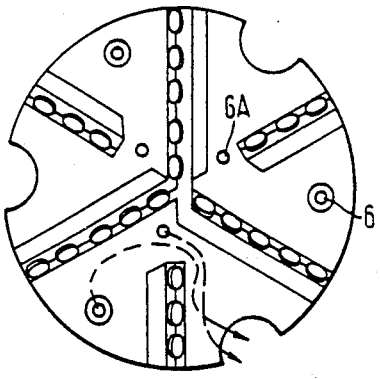

In the embodiment of FIG. 6, auxiliary nozzles 6A are present to enhance the cleaning action on the second set of cutting elements by releasing auxiliary driling mud in the gap G.

Figure 7:
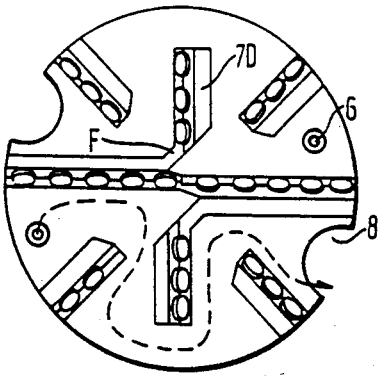

In the embodiment of FIG. 7, the flow of mud is caused to pass over four sets of cutting elements before exiting via a junk slot 8. The blades 7D do not reach the kickers and are joined at the centre by fences F.

Figure 8:
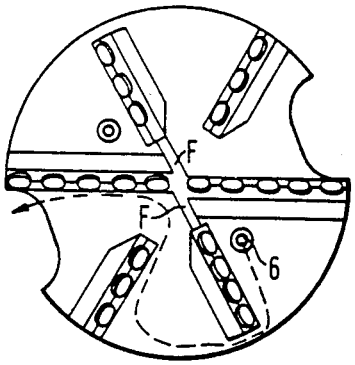

In the embodiment of FIG. 8, the nozzle openings 6 are in the central region of the bit face and the fluid is directed to travel away from the central axis and then toward it before exiting in the gauge region.

Figure 9:
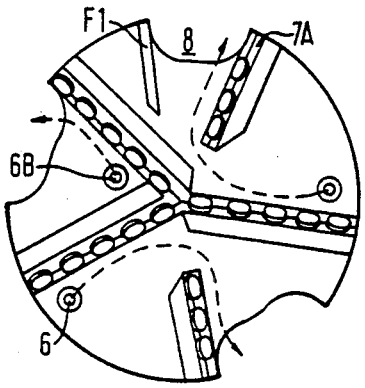

In the embodiment of FIG. 9, there are three junk slots 8. In the case of the nozzle 6B the mud cleans only one set of cutting elements and then goes direct to the facing junk slot 8; in the case of the other outlet nozzles 6 the mud passes two sets of cutting elements. A fence F is present to increase the fluid velocity in front of the blade 7A.

Figure 10:
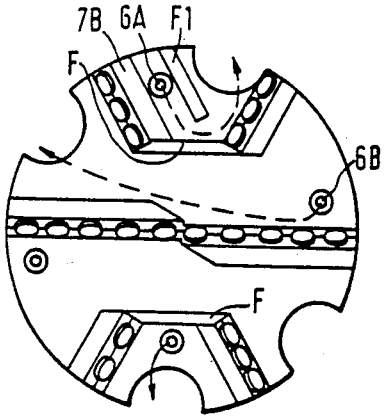

In the embodiment of FIG. 10, the fence F1 increases the mud velocity in front of the blade 7A. The fences F join the blades 7A to the blades 7B to separate the path from the nozzle 6A from that of the nozzle 6B.

Figure 11:
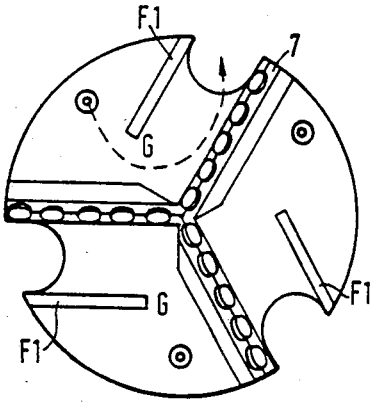

In the embodiment of FIG. 11, a fence F1 is provided adjacent the junk slot 8 to direct the flow of mud past the cutting elements from outlet nozzles 6 which would otherwise need to be positioned nearer to the central axis.

Figure 12:
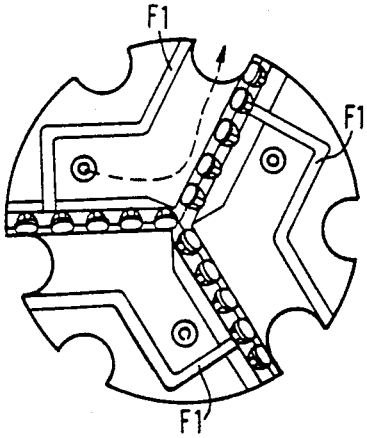
Figure 13:
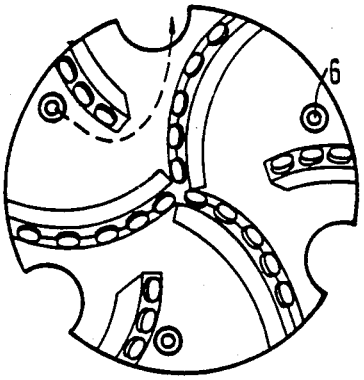

In the embodiment of FIG. 12, the fences F1 extend from adjacent the outlet to the junk slot better to define the clear flow path. In the embodiment of FIG. 13, the blades are curved, permitting cutting elements to be oriented with non-zero side rake angles while still being in mutual alignment with their neighbours.

Figure 14:
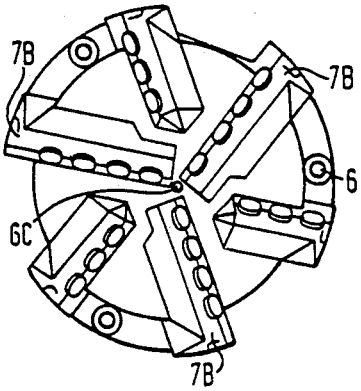

In the embodiment of FIG. 14, there is a small centre non-interchangeable nozzle 6C to clean the central cutters and join the flow from the main nozzle 6. It will be noticed that the fluid emerging from nozzle 6C will tend to divide. The bit includes leakage paths of small cross-sectional area between the blades 7A.

Figure 15:
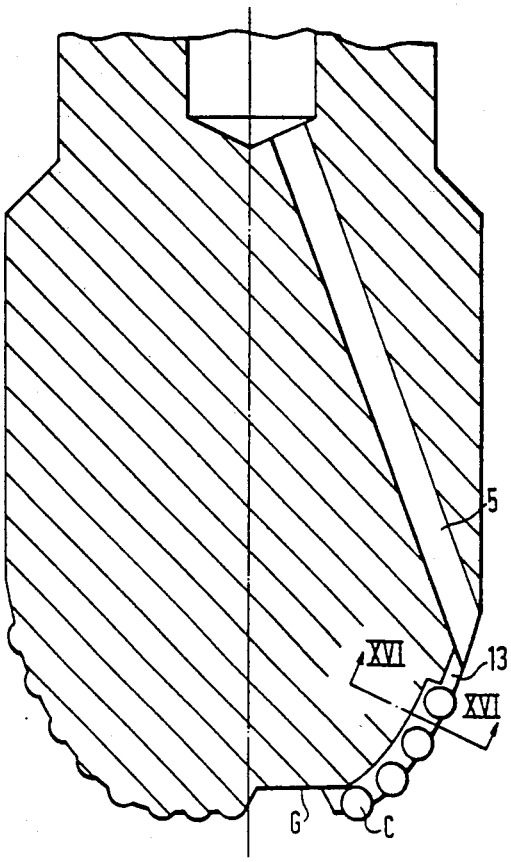
FIG. 15 is a longitudinal sectional view of another bit of the invention.
Figure 16:
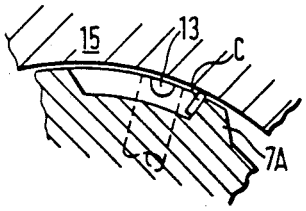
FIG. 16 is a sectional view taken on lines XVI—XVI on FIG. 15.

In the embodiment shown in FIGS. 15 and 16 the bit includes a restrictor 13 on the surface of the bit whose restricted cross-sectional area is bounded partly by part of the bit body and partly by the formation or rock being drilled.

I claim:

1. A rotary bit for use in drilling a borehole in a subsurface formation comprising a bit body having a central bore, the body having a leading face and a trailing gauge region, said gauge region having a plurality of generally longitudinally-extending, circumferentially spaced flow slots recessed thereinto for permitting flow of fluid longitudinally along said gauge region, and a plurality of flow-restrictive surfaces interposed between said flow slots for contacting the wall of such borehole, walls on the bit dividing the leading face into fluid channels, cutting elements on at least some of the walls, passageways connecting the central bore to openings in the fluid channels, wherein, as to at least one of said openings, the nearest portion of said gauge region generally radially aligned with said opening is an adjacent one of said flow-restrictive surfaces, wherein at least two wall portions are arranged relative to such opening so that most of the fluid emerging therefrom is directed to travel in a path inwardly along said leading face towards the central axis of the bit and then to one of said slots in the gauge region, at least some of said cutting elements being disposed in said path, the adjacent flow restrictive surface of said gauge region being adapted to cooperate with the wall of such borehole to inhibit fluid from such opening from flowing directly outwardly in a generally radial direction and thence along said gauge region.

2. A rotary bit according to claim 1, wherein most of the openings are located near the periphery of the bit and the fluid channels lead from these openings first towards the central axis of the bit and from there outwards to the periphery towards a junk slot.

3. A rotary bit according to claim 1, wherein the number and size of the openings are such as to provide a pressure drop of between 10 and 200 atmospheres.

4. A rotary bit according to claim 1, wherein said wall portions are provided by blades on which said cutting elements are mounted and/or by fences spaced from said blades.

5. A rotary bit according to claim 1, wherein auxiliary openings are provided in the fluid channels adjacent the central axis of the bit.

6. A rotary bit according to claim 1, wherein the cutting elements on the bit face are aligned with their neighbours and the channels are adapted to direct fluid flow near each cutting element is in a direction substantially parallel to the face of the cutting element.

7. A rotary bit according to claim 6, wherein each passageway from said central bore to an opening is provided with a choke or restrictor to control the fluid flow.

8. A rotary bit according to claim 1, wherein the cutting elements are polycrystalline diamond compacts.

9. A rotary bit according to claim 1, wherein two or more inbound fluid channel sections, leading from two or more openings respectively radially inwardly along the leading face of the bit, feed one common outbound channel section leading radially outwardly along the leading face of the bit to one of the slots of the gauge region of the bit.

10. A rotary bit according to claim 1 wherein a plurality of said openings each have respective ones of said wall portions so arranged relative to said openings to so direct most of the fluid emerging from said opening to travel in such a path.

11. A rotary bit according to claim 10, wherein those cutting elements disposed in said paths are disposed generally on said walls.

12. A rotary bit according to claim 11, wherein said cutting elements are polycrystalline diamond compacts.

13. A rotary bit according to claim 10 wherein said channels are arranged to direct most of fluid from all of said openings along said leading face, past the cutting elements, to the gauge region.

14. A rotary bit according to claim 13 wherein at least some of said paths are substantially unbranched.

* * * * *

UNITED STATES PATENT AND TRADEMARK OFFICE

CERTIFICATE OF CORRECTION

PATENT NO. : 4,577,706

DATED : March 25, 1986

INVENTOR(S) : John D. Barr

It is certified that error appears in the above—identified patent and that said Letters Patent is hereby corrected as shown below:

In Column 6, line 29, delete "6" and insert therefor --1--.

Signed and Sealed this

*Twenty-sixth* Day of *August 1986*

[SEAL]

*Attest:*

DONALD J. QUIGG

*Attesting Officer*

*Commissioner of Patents and Trademarks*